United States Patent [19]

Logan

[11] 4,413,581

[45] Nov. 8, 1983

[54] OPTICAL SWITCHING ARRANGEMENT FOR A SEWING MACHINE

[75] Inventor: William W. Logan, Glen Ridge, N.J.

[73] Assignee: The Singer Co., Stamford, Conn.

[21] Appl. No.: 482,743

[22] Filed: Apr. 7, 1983

Related U.S. Application Data

[63] Continuation-in-part of Ser. No. 364,129, Mar. 31, 1982, abandoned.

[51] Int. Cl.[3] ..... B65H 63/02; D05B 51/00; D05B 3/06

[52] U.S. Cl. ..... 112/278; 112/158 B

[58] Field of Search ..... 112/278, 273, 158 B, 112/158 E; 139/273 A; 250/561, 571

[56] References Cited

U.S. PATENT DOCUMENTS 3,843,883 10/1974 De Vita et al. ..... 112/273 X
3,991,692 11/1976 Papajewski et al. ..... 112/278
4,178,866 12/1979 Adams ..... 112/278
4,188,902 2/1980 Kahan ..... 112/278
4,214,542 7/1980 Odermann ..... 112/278
4,237,807 12/1980 Meier et al. ..... 112/278

*Primary Examiner*—Peter P. Nerbun
*Attorney, Agent, or Firm*—David L.. Davis; Robert E. Smith; Edward L. Bell

[57] ABSTRACT

An optical switching arrangement for a sewing machine when used as a low bobbin thread detection and indicating system utilizes an infra-red light emitting diode and a phototransistor arranged on opposite sides of the bobbin so that an amount of bobbin thread greater than a predetermined threshold interrupts the light path from the light emitting diode to the phototransistor. A single integrated circuit chip is utilized to modulate the emission from the light emitting diode and to demodulate the output of the phototransistor to differentiate the detected emission from ambient radiation. The same basic configuration is also applied to an optical buttonhole switching arrangement.

10 Claims, 5 Drawing Figures

OPTICAL SWITCHING ARRANGEMENT FOR A SEWING MACHINE

DESCRIPTION

This is a continuation-in-part of the co-pending application Ser. No. 364,129, filed on Mar. 31, 1982, now abandoned.

BACKGROUND OF THE INVENTION

This invention relates to sewing machines and, more particularly, to an optical switching arrangement within a sewing machine.

There are a number of known optical switching arrangements for sewing machines in the prior art. For example, such arrangements are known for signalling a sewing machine operator as to the impending depletion of bobbin thread. This is desirable in order to warn an operator of impending bobbin thread exhaustion which might interfere with the appearance of a long seam. A number of these arrangements utilize a light source and a light detector arranged so that when there is thread on the bobbin the optical path from the light source to the light detector is blocked, this path being opened when the amount of thread remaining on the bobbin is depleted below some threshold value. Upon the occurrence of this latter condition, appropriate circuitry activates an alarm, or indicator, that warns the operator that the amount of thread remaining on the bobbin is below the predetermined threshold. Many of these arrangements have frequently been of limited reliability due to the effect of stray light producing erroneous triggering of the low bobbin thread warning alarm. Most attempts to eliminate the effect of stray light from such sources as room lighting and sewing machine mounted work guiding lights have been limited to enclosing the loop taker cavity in which the light sensitive photo detector resides with an opaque bed slide and spraying the cavity with a flat black paint treatment to reduce internal reflections from reaching the light detector. Other attempts have involved defining a narrow optical path from the light source to the light detector and providing shielding about the lift detector to block all light other than that which emanates from the light source. While these prior arrangements are somewhat effective, they still allow some amount of ambient light to penetrate and they have the further problem that the light level is diminished by the shielding. Further, most of these prior arrangements utilize a relatively expensive subminiature incandescent lamp.

Another application utilizing optical switching in a sewing machine is for buttonholing. In particular, a movable buttonhole foot may carry reflective means, the movement of which is sensed as the foot is moved by the fabric feeding movement of a feed dog against the garment being sewn. Mounted on the sewing head is a light source and light detector, both focused down toward the reflective means. It is apparent that the light detector is exposed to stray ambient light.

It is therefore an object of the present invention to provide an improved optical switching arrangement for a sewing machine.

It is a further object of this invention to provide a low bobbin thread detection and indication system which is both reliable and cost effective.

It is another object of this invention to provide an optical buttonhole switching arrangement for a sewing machine which is both reliable and cost effective.

SUMMARY OF THE INVENTION

The foregoing and additional objects are attained in accordance with the principles of this invention by providing in a sewing machine having a control system, an improved means responsive to the condition of an element for providing a signal to the control system, the condition responsive means including a light source and a light detector. The inventive arrangement includes means for providing a modulation signal, means utilizing the modulation signal for driving the light source, and means utilizing the modulation signal for examining the output of the light detector.

In accordance with an aspect of this invention, the modulation signal providing means includes an oscillator.

In accordance with a further aspect of this invention, the light source includes an infrared light emitting diode.

BRIEF DESCRIPTION OF THE DRAWINGS

The foregoing will be more readily apparent upon reading the following description in conjunction with the drawings in which like reference characters in different figures thereof denote like elements and wherein.

DETAILED DESCRIPTION

Figure 1:
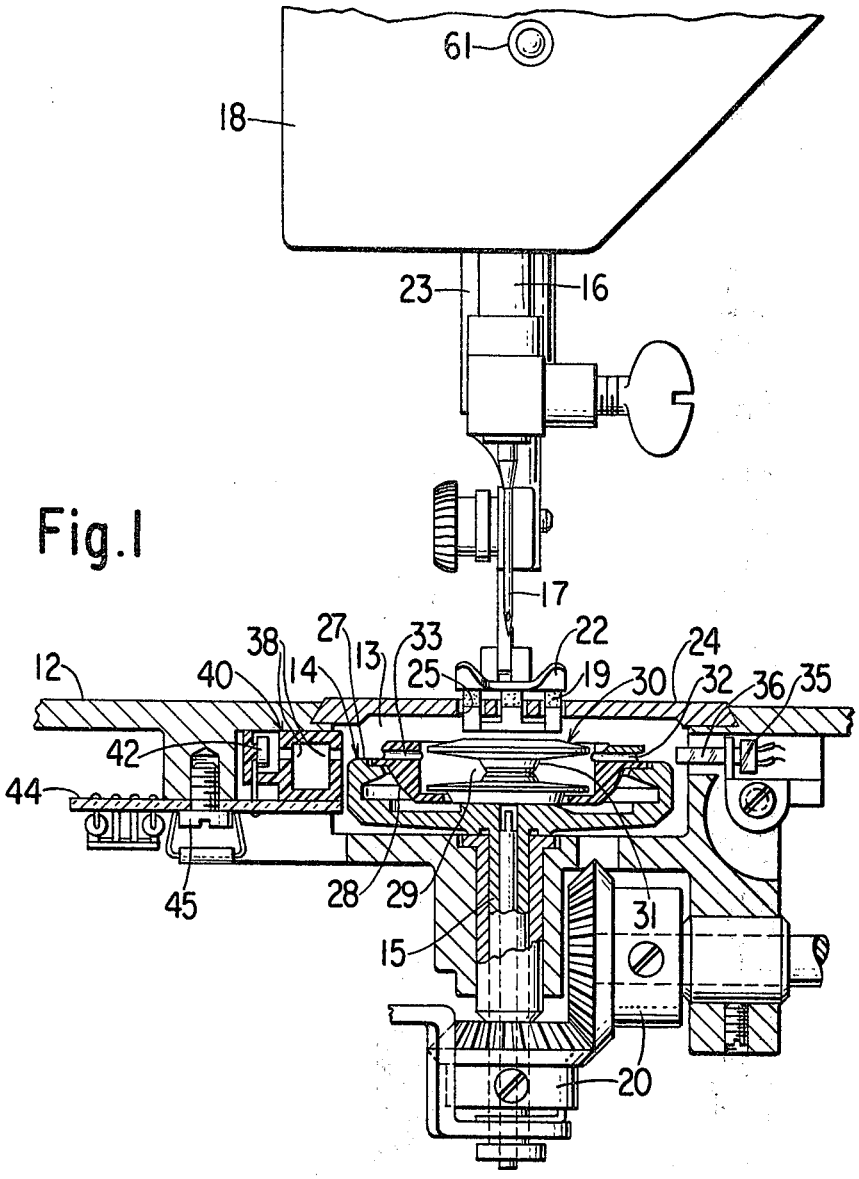
FIG. 1 is an enlarged view of a portion of the head end and loop taker of a sewing machine shown partially in section in order to show more detail thereof and in which an embodiment of this invention may be incorporated.

Referring now to the drawings, FIG. 1 shows a portion of a sewing machine having a bed 12 and a sewing head 18 overhanging the bed 12. The bed 12 is formed with a cavity 13 in which a loop taker 14 is rotatably carried on one extremity of a shaft 15 oriented so as to have a vertical axis. The shaft 15 is driven by bevel gears 20 which are driven in the usual manner by the main sewing machine drive motor (not shown). The loop taker 14 rotates in timed synchronization to the reciprocation of the needle bar 16, the needle 17 carried by the needle bar 16 being driven in endwise reciprocation through a work material supported in the bed 12 for cooperation with the loop taker 14 carried therein in the formation of stitches. A feed dog 19 is visible which is a portion of a feeding system (not shown) for feeding work material under the sewing needle 17 in order to generate a pattern of stitches. The work material is pressed against the feed dog 19 by a presser foot 22 supported on the end of a presser bar 23 which is urged downwardly in a manner well known in the sewing machine art. A throat plate 24 supports the work material and is fashioned with an orifice (not shown) through which the sewing needle 17 may project. The throat plate 24 is further formed with slots 25 through which the feed dog 19 may extend.

Figure 2:
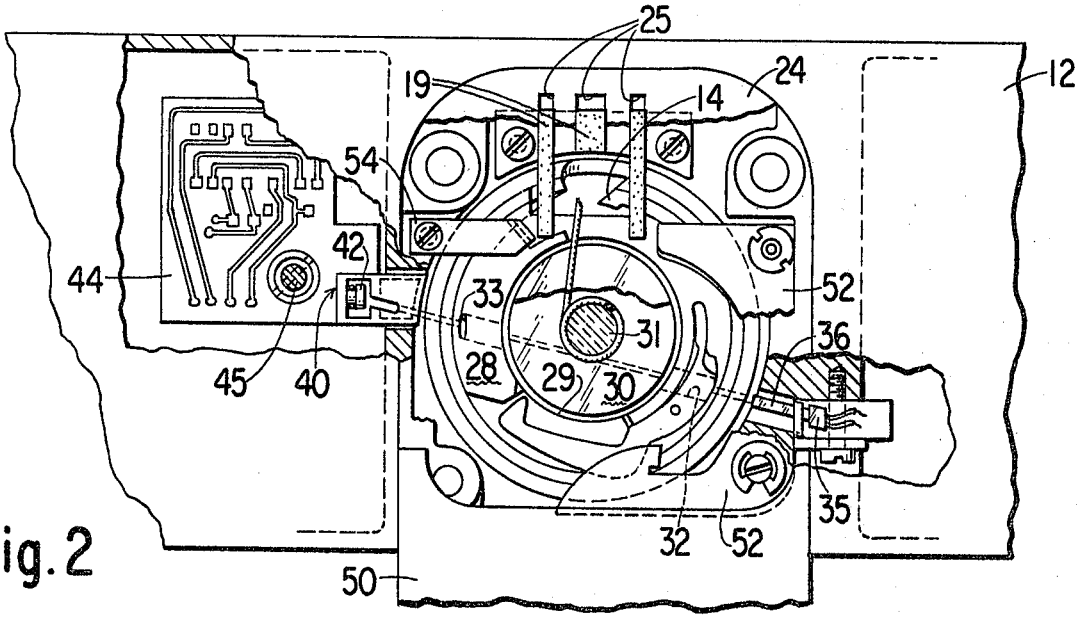
FIG. 2 is a plan view of the loop taker and bobbin area of the sewing machine shown in FIG. 1 indicating the placement of a light detector and box therefor and a light source.

The loop taker 14 supports on a race 27 thereof a bobbin case 28. The bobbin case 28 is restrained from rotary motion with the loop taker 14 by a position plate 52 (FIG. 2). The bobbin case 28 is fashioned with a cavity 29 within which is supported a bobbin 30 for the carrying of lower thread for a lockstitch. A further explanation of the loop taker 14, the bobbin case 28 and the bobbin 30 arrangement and how thread may be wound thereupon may be had by reference to U.S. Pat. No. 3,693,566. The teachings of this patent have been modified somewhat by extending the bobbin case 28 above the level of the loop taker 14 in order that bores 32, 33 might extend therethrough roughly tangent the hub 31 of the bobbin 30 (FIG. 2). The purpose of the bores 32, 33 is to allow the passage of light from a light source 35 as focused by a lens 36. The light rays extending from the bore 33 pass through orifices 38 in a mask box 40, which box 40 supports a light detector 42 on an inner wall thereof aligned with the orifices 38 and the bores 32, 33. A printed circuit board 44 is affixed to the bed 12 by means of a screw 45 and the mask box 40 is supported on the printed circuit board 44 with the light detector 42 having electrical connections thereto.

Referring now to FIG. 2, there is shown a plan view of the left side of the bed 12 showing the cavity 13 therein with the throat plate 24 removed and with a bed slide 50 thereof slid back to expose the loop taker 14, the bobbin case 28 and the bobbin 30. There is also visible a portion of the position plate 52 and a position finger 54 which serve to retain the bobbin case 28 in a stationary position against rotation with the loop taker 14 while permitting thread to be cast thereabout.

Figure 3:
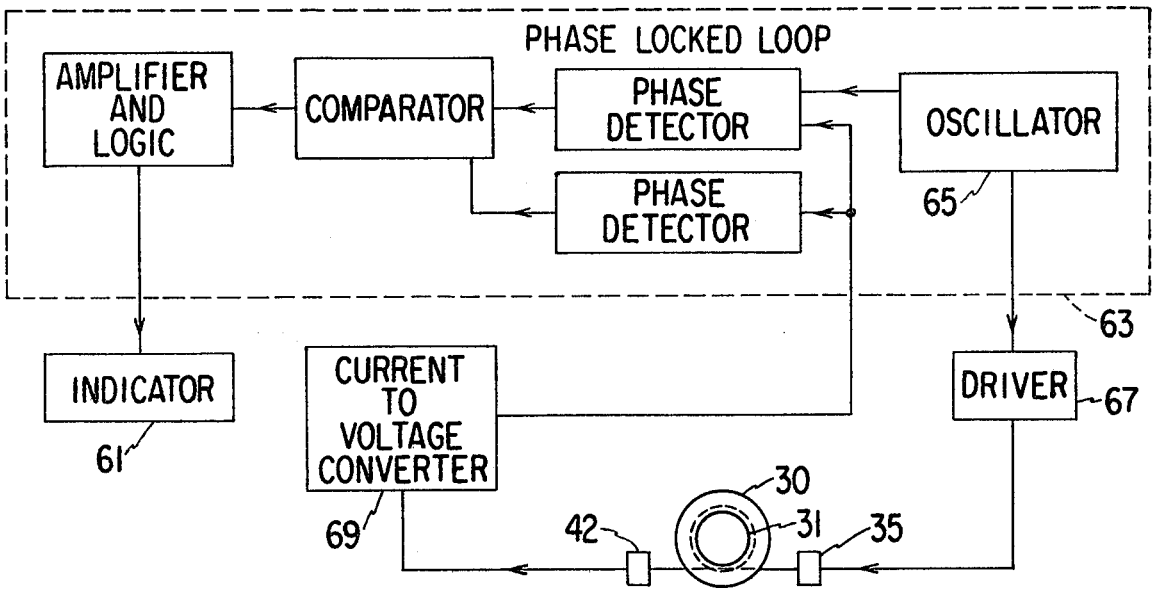
FIG. 3 is a block diagram of circuitry operating in accordance with the principles of this invention.

It will be readily appreciated by one skilled in the art of sewing that it is inconvenient to exhaust the supply of bobbin thread while in the middle of a sewing project. Inasmuch as the bobbin is located within the sewing machine bed 12 over which is draped the garment or fabric being sewn, it will be appreciated that it is difficult to readily observe the quantity of thread remaining on the bobbin while carrying out the sewing process. To the end of alleviating the problems attendant with observing the quantity of bobbin thread, there is provided an indicator, illustratively a light emitting diode 61, preferably mounted on the head 18 of the sewing machine where it is readily visible to an operator, for informing the operator when the amount of thread remaining on the bobbin falls below a predetermined threshold. FIG. 3 is a system block diagram of circuitry for controlling the illumination of the indicator 61 in response to the amount of thread remaining on the bobbin 30. In accordance with the principles of this invention, an infra-red light emitting diode is utilized as the light source 35. The use of such a device provides two distinct advantages. First, it is considerably less expensive than a subminiature incandescent lamp. Second, lint is much less able to block the infra-red radiation than the visible light from an incandescent lamp. The present invention contemplates modulating the emission from the light emitting diode 35 so that this emission can be differentiated from ambient radiation by a frequency sensitive filter. The output from the filter is demodulated to produce a signal showing whether or not the emission from the light emitting diode 35 is interrupted by a sufficient amount of thread remaining wound on the bobbin 30.

In accordance with the principles of this invention, both the modulation and demodulation (detection) functions are performed by a simple phase locked loop circuit 63. Thus, as shown in FIG. 3, the phase locked loop 63 uses the same oscillator circuit 65 for both modulation and demodulation. Accordingly, there is no filter required, per se, since the use of a single oscillator for both modulation and demodulation results in inherently synchronous operation. Thus, the oscillator 65 causes a driver 67 to drive the light emitting diode 35. The light detector 42 provides a current depending upon the amount of radiant energy impinging thereon. This current is changed to a voltage by the current to voltage converter 69, whose output is coupled to the phase locked loop 63. When the phase locked loop 63 receives a sufficient signal from the converter 69 to indicate that the path between the light source 35 and the light detector 42 is clear of bobbin thread, it provides a signal to the indicator 61, to inform the operator of the impending depletion of bobbin thread.

Figure 4:
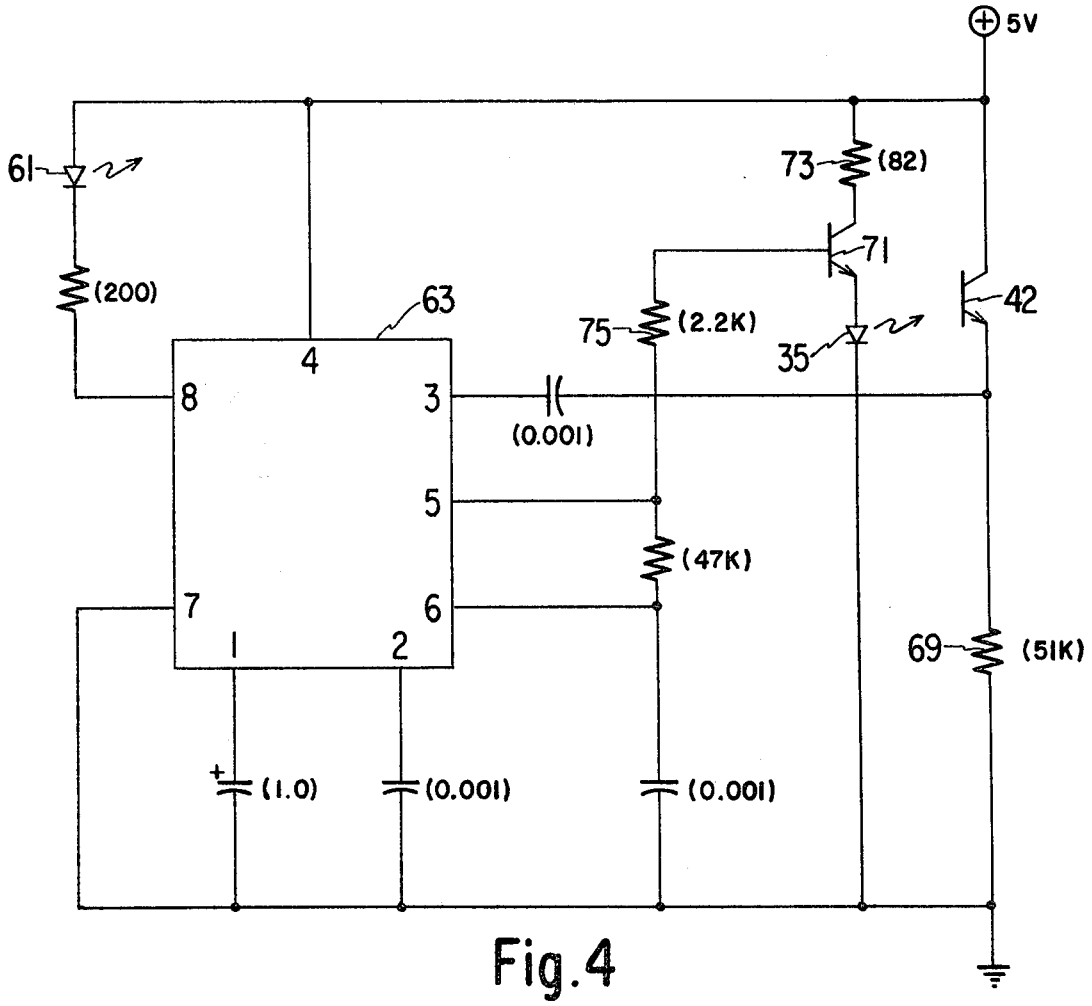
FIG. 4 is a detailed circuit diagram of a preferred implementation for the system shown in FIG. 3.

Referring now to FIG. 4, shown therein is a preferred implementation of the system depicted in block diagram form in FIG. 3. The function of the phase locked loop 63 is preferably performed by a single integrated circuit chip, illustratively a type LM567/LM567C Tone Decoder manufactured by National Semiconductor. The light source 35 is preferably an infra-red light emitting diode. The light detector 42 is preferably a phototransistor. The indicator 61 is preferably a light emitting diode. The driver 67 preferably comprises the transistor 71 and the resistors 73 and 75. The current to voltage converter 69 is preferably a resistor.

In FIG. 4, the numbers within the block 63 refer to the manufacturer's terminal numbers. The numbers in parentheses next to the resistors and the capacitors are the resistance values, in ohms, and the capacitance values, in microfarads, for a preferred circuit embodiment which operates at a frequency of 2,300 Hertz.

Figure 5:
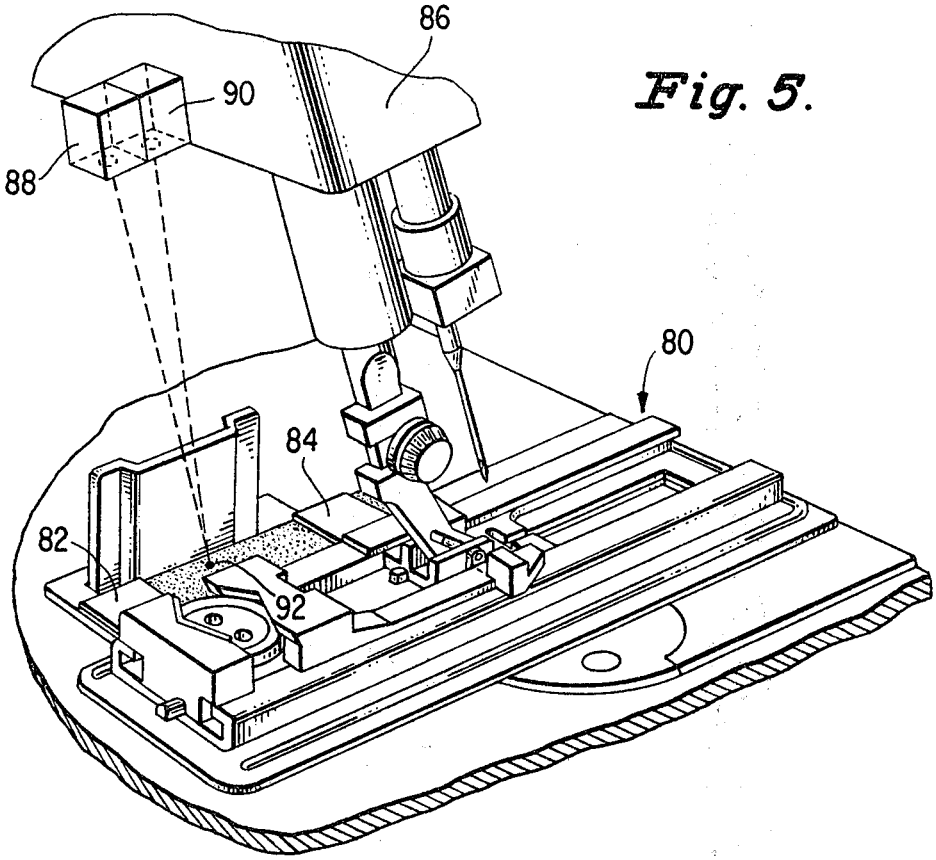
FIG. 5 is a perspective view of a buttonhole presser foot, light source and light detector, which may be utilized in another embodiment of this invention.

FIG. 5 illustrates an optical buttonhole mechanism similar to that disclosed in U.S. Pat. No. 4,216,732, the contents of which are hereby incorporated by reference as is fully set forth herein. For purposes of understanding the present invention, the buttonhole foot 80 includes a fixed reflective area 82 and a movable reflective area 84, the distance between which corresponds to the desired length of a buttonhole being sewn, as is well known in the art. Mounted on the head 86 of the sewing machine is a light source 88 and light detector 90, both of which are focused to substantially the same point 92 along the path of travel of the reflective areas 82, 84. Accordingly, when one of the reflective areas 82, 84 is positioned at the point 92, the light from the light source 88 is reflected therefrom and received by the light detector 90. (It is noted that the positions of the light detector 90 and the light source 88 may be reversed). The light source 88 and the light detector 90 may be connected in a circuit configuration like that shown in FIG. 4, with the output from the terminal 8 of the phase locked loop circuit 63 being utilized in the conventional manner for advancing the buttonhole sequence. This described arrangement provides the desired result that ambient light reflected from the areas 82, 84 is inherently filtered out.

Accordingly, there has been disclosed an improved optical switching arrangement for a sewing machine. It is understood that the above-described embodiment is merely illustrative of the application of the principles of this invention. Numerous other embodiments may be devised by those skilled in the art without departing from the spirit and scope of this invention, as defined by the appended claims. For example, the aforedescribed arrangement may also be adapted for use in an optical edge guiding system to reduce the effects of stray light.

I claim:

1. A sewing machine having a frame including a bed, said bed having a cavity for receiving a loop taker, a loop taker rotatably supported in said cavity, a bobbin case supported in said loop taker against rotation therewith, said bobbin case freely supporting a lower thread carrying bobbin therein, and means for sensing the thread carrying condition of said bobbin, said sensing means including a light source and a light detector, wherein the improvement comprises:

means for providing a modulation signal;

means utilizing said modulation signal for driving said light source; and means utilizing said modulation signal for examining the output of said light detector.

2. The improvement according to claim 1 wherein said modulation signal providing means includes an oscillator.

3. The improvement according to claim 1 wherein said light source comprises an infra-red light emitting diode.

4. The improvement according to claim 2 wherein the functions of said modulation signal providing means and said examining means are performed by a phase locked loop circuit.

5. In a sewing machine having a control system and means responsive to the condition of an element for providing a signal to said control system, said condition responsive means including a light source and a light detector, the improvement comprising:

means for providing a modulation signal;

means utilizing said modulation signal for driving said light source; and means utilizing said modulation signal for examining the output of said light detector.

6. The improvement according to claim 5 wherein said modulation signal providing means includes an oscillator.

7. The improvement according to claim 5 wherein said light source comprises an infra-red light emitting diode.

8. The improvement according to claim 6 wherein the functions of said modulation signal providing means and said examining means are performed by a phase locked loop circuit.

9. The improvement according to claim 5 wherein said element is a lower thread carrying bobbin and said condition is the thread carrying condition of said bobbin.

10. The improvement according to claim 5 wherein said element is a movable buttonhole foot and said condition is the position of said buttonhole foot, the improvement further including a reflective area on said buttonhole foot and means for focusing said light source and said light detector to substantially the same position along the path of travel of said reflective area.

* * * * *